United States Patent [19]

Wurz et al.

[11] Patent Number: 4,691,766

[45] Date of Patent: Sep. 8, 1987

[54] FINNED TUBE ARRANGEMENT FOR HEAT EXCHANGERS

[76] Inventors: Dieter Wurz, Riefstahlstrasse 6, 7500 - Karlsruhe; Paul Paikert, Brunsbergweg 5a, 5810 Witten, both of Fed. Rep. of Germany

[21] Appl. No.: 829,160

[22] Filed: Feb. 14, 1986

Related U.S. Application Data

[63] Continuation-in-part of Ser. No. 630,244, Jul. 12, 1984, abandoned.

[30] Foreign Application Priority Data

Jul. 18, 1983 [DE] Fed. Rep. of Germany ..... 3325876

[51] Int. Cl.[4] ..... F28F 13/00; F28F 13/12; F28F 1/10; F24B 1/06

[52] U.S. Cl. ..... 165/135; 165/124; 165/172; 165/900; 165/903

[58] Field of Search ..... 165/151, 111, 113, 133, 165/172, 171, 903, 124, 900

[56] References Cited

U.S. PATENT DOCUMENTS

| | | | |
|---|---|---|---|
| 3,385,198 | 5/1968 | Farr | 165/99 |
| 3,612,172 | 10/1971 | Dohnt | 165/111 |
| 4,144,933 | 3/1979 | Asselman et al. | 165/151 |
| 4,335,797 | 6/1982 | Simmons | 165/135 |
| 4,503,931 | 3/1985 | Sugimoto et al. | 165/135 |

FOREIGN PATENT DOCUMENTS

| | | | |
|---|---|---|---|
| 1940963 | 2/1971 | Fed. Rep. of Germany | 165/172 |
| 2450232 | 5/1975 | Fed. Rep. of Germany | 165/151 |
| 509109 | 7/1939 | United Kingdom | 165/151 |
| 2143631 | 2/1985 | United Kingdom | 165/151 |
| 1008606 | 3/1983 | U.S.S.R. | 165/124 |

*Primary Examiner*—Albert W. Davis, Jr.
*Assistant Examiner*—John K. Ford
*Attorney, Agent, or Firm*—Laubscher & Laubscher

[57] ABSTRACT

In finned tube arrangements for cooling a medium which flows in the finned tubes by a second medium which flows outside of the finned tubes and transversely thereof, flow guide elements are positioned at the inflow side and/or at the outflow side of the finned tube arrangement to reduce the pressure loss and, possibly, increase the heat transfer coefficient.

4 Claims, 12 Drawing Figures

FINNED TUBE ARRANGEMENT FOR HEAT EXCHANGERS

This application is a continuation-in-part of application Ser. No. 630,244 filed July 12, 1984, now abandoned.

BACKGROUND OF THE INVENTION

The invention relates to a finned tube arrangement for heat transfer between a first medium flowing in the finned tubes and a second medium flowing outside of the finned tubes and in a direction transversely thereof, comprising flow guide elements.

BRIEF DESCRIPTION OF THE PRIOR ART

In a known finned tube arrangement of this kind, embodied by a sheet metal finned heat exchanger, the flow guide elements are designed as spacer bands between the individual finned sheets and surrounding the inner tubes (DE-OS 31 16 033). The known structure impairs the heat flow between the inner tubes and the sheet metal fins and does not present the optimum in flow techniques and, moreover, its manufacture and assembly are costly.

If heat is to be transferred from a liquid or gaseous condensation medium (e.g. water or steam) to another gaseous medium (e.g. air) through separating walls, the predominant part of the heat transfer resistance lies at the wall side along which the gaseous medium flows. The side facing the gaseous medium must be given the greatest possible surface area in order to improve the heat transfer. This requirement has led to the development of the well known finned tubes. These finned tubes are provided at their outer side around which the gas flows with fins which enlarge the heat transfer area quite considerably and which extend transversely of the longitudinal direction of the tube, surrounding the same annularly.

Often, finned tubes are arranged in a layer or in several consecutively disposed layers or bundles. The pressure loss, particularly of the gaseous medium flowing through the bundles of finned tubes, is quite considerable. For instance, in a power plant generating some 1000 MW of electric power and operating by direct condensation of steam through heat transfer to cooling air, the power required for operation of fans which draw the gaseous medium past the finned tubes is approximately 10 MW (this corresponds to costs of about 4 million German marks per year). For this reason, it has long been desired to reduce the pressure loss at the outside or the side of the gas of the finned tubes.

On the other hand, however, the reduction of the pressure loss was not to cause a disproportionately great reduction of the heat transfer coefficient. This would provide poorer heat transfer so that a correspondingly greater number of relatively expensive finned tubes would have to be used.

SUMMARY OF THE INVENTION

Accordingly, it is an object of the invention to provide a finned tube arrangement wherein the coefficient of pressure loss is as low as possible and the coefficient of heat transfer is as high as possible. The optimum values of the coefficients of pressure loss and heat transfer depend on the manufacturing costs of the finned tubes and on the price to be paid for the fan performance.

This object is met, in accordance with the invention, with a finned tube arrangement including flow guide elements which are disposed in the inflow and/or outflow of the second medium (gas) toward and/or away from the finned tubes and shaped like airfoils.

The expression "airfoil" is understood to include flow guide elements of symmetrical and even circular cross sections.

The flow guide elements according to the invention lower the coefficient of pressure loss without reducing the coefficient of heat transfer. This permits savings in fan performance.

An advantageous modification of the invention is characterized in that the flow guide elements include surfaces by means of which the second medium can be guided toward the inner tubes of the finned tubes.

In accordance with a preferred manufacturing technique, the flow guide elements comprise sectional elements or profiles particularly made of synthetic plastic material and extending in the longitudinal direction of the finned tubes, with current manufacturing methods, the flow guide elements can be produced inexpensively by extrusion.

It is advantageous to have the flow guide elements disposed in planes which are offset with respect to the main flow planes of the finned tubes. In this manner the inflowing medium (gas) is directed toward the inner tubes of the finned tubes. This is true particularly if the flow guide elements have tapering portions each fitting snugly within the constriction between two adjacent finned tubes. This modification of the invention is favorable also from the point of view of the manufacturing technique because, at the same time, the flow guide elements can be secured or connected in simple manner to the peripheries of the fins.

If flow guide elements or parts therof disposed at the outflow side of the finned tubes are designed to form diffusor or diffusion channels in accordance with another advantageous modification of the invention, speed energy may be recovered at the outflow side so that further savings of fan performance are obtained.

The invention is applicable with particular advantage in finned tube arrangements in a pack comprising a plurality of layers of finned tubes which are offset with respect to one another. In this case, additional flow guide elements are disposed between the individual layers of finned tubes in planes which are offset with respect to the main inflow planes of the finned tubes in the outer layers of the pack.

One specific embodiment of flow guide elements disposed in the inflow, in accordance with the invention, is characterized in that these flow guide elements are thickened in the direction of flow from their leading edge to a place of maximum thickness behind their middle and subsequently have an end which is concavely curved at both sides in adaption to the constriction between the fins of adjacent finned tubes.

One specific embodiment of flow guide elements disposed in the outflow is characterized in that these flow guide elements have a place of maximum thickness upstream of their middle and subsequently have a V-shaped tapering portion along the major part of their length.

It is advantageous particularly with single layer finned tube arrangements including oval tubes to have the flow guide elements at the inflow side formed integral with those at the outflow side. In accordance with a corresponding further development of the invention each flow guide element thus has an inlet portion located in the inflow, an outlet portion located in the outflow, and a tapering portion in between.

A contribution to reducing the pressure loss coefficient is obtained also if the inner tube themselves have an outline which is designed to provide favorable flow.

A flow and heat transfer boundary layer of increasing thickness in the direction of flow is formed along the fins. This boundary layer impairs the coefficient of heat transfer in the direction of flow. To reduce this effect, another modification of the invention provides for flow guide elements to be located at the front edges of the fins so as to generate a regular turbulent flow.

The longitudinal vortices of the regular turbulent flow transport cool air to the fins, whereas the warmer air collects in the eye of the vortex.

The flow guide elements are formed advantageously of triangular lugs cut out of the front edges of the fins and bent into the flow. The arrangement of these latter type of flow guide elements at the front edges of the fins is advantageous in that the flow velocities at that location are still relatively slow because there is not yet a strong displacing effect of the inner tubes in this area. The longitudinal vortices released at the front edge of the fins increase in circumferential speed during the acceleration of the cooling air because of the displacing effect of the inner tube. All of this contributes to increasing the heat transfer coefficient.

The inventor recognized and verified by calculations that only a rather small proportion of the pressure loss at the side of the gas is caused by the wall shear stress of the boundary layers of the flow (frictional resistance). Consequently considerable proportions of the pressure loss should result from inhomogeneous distributions of velocities and subsequent turbulences.

The flow guide surfaces formed at the flow guide elements reduce these inhomogeneous phenomena of the fields of flow. Forming diffusion channels at the outflow sides of the flow guide elements permits recovery of a considerable portion of the dynamic pressure of the gas flow. It should be possible to reduce the overall pressure loss to approximately 40% by the measures of the invention without getting a poorer heat transfer coefficient. On the contrary, it must be expected that the coefficient of heat transfer is raised because the invention provides for improved flow around the inner tubes.

In practice, such as in cooling towers, the finned tubes often are installed in such a way that loss-free inflow and outflow transversely of the longitudinal axes of the finned tubes is not given. Thus the flow of the outer medium must be deflected in a direction transversely of the longitudinal direction of the finned tubes so as to pass the radial fins in order to be deflected subsequently in the opposite direction so as to exit from the cooling tower. The deflection is brought about by the arrangement of the finned tubes, specifically by the fins themselves which are disposed radially on the inner tubes, and this involves losses.

It is another object of the invention to provide a finned tube assembly which warrants optimum, i.e. the best possible loss-free inflow into and/or outflow out of the finned tubes substantially transversely of the finned tubes.

To meet this object there is provided in a finned tube heat exchanger assembly, including a plurality of parallel tubes each having a plurality of longitudinally-spaced, radially-extending annular fins mounted concentrically thereon, thereby to afford heat transfer between a first fluid medium flowing through the tubes and a second fluid medium flowing externally of and in a direction normal to the axes of the tubes, a plurality of flow guide members of airfoil configuration arranged transversely of the finned tubes in the inflow and outflow paths, respectively, of the second fluid medium with respect to the finned tubes.

In accordance with a further development of the invention, these flow guide members extending transversely of the finned tubes may intersect flow guide members which extend parallel to the finned tubes, i.e. may be provided in addition to the flow guide members extending in the longitudinal direction. Even in an arrangement alone, too, the flow guide members extending transversely of the finned tubes afford considerable improvement of the inflow into the finned tubes and consequently of the heat exchange at the fins.

In accordance with another modification of the invention, the spacing between adjacent flow guide members extending transversely of the finned tubes lies in the range of from one to five times the diameter of the inner tubes.

A finned tube assembly according to the invention is especially well suited for the inclined installation of layers of finned tubes in ventilator or natural draft dry cooling towers and it is useful when the air flows in and out either horizontally or vertically, i.e. not transversely of the longitudinal direction of the finned tubes but rather at an oblique angle of incidence.

BRIEF DESCRIPTION OF THE FIGURES

Other objects and advantages of the present invention will become apparent from a study of the following specification when viewed in the light of the accompanying drawing, in which.

DETAILED DESCRIPTION

Figure 1:
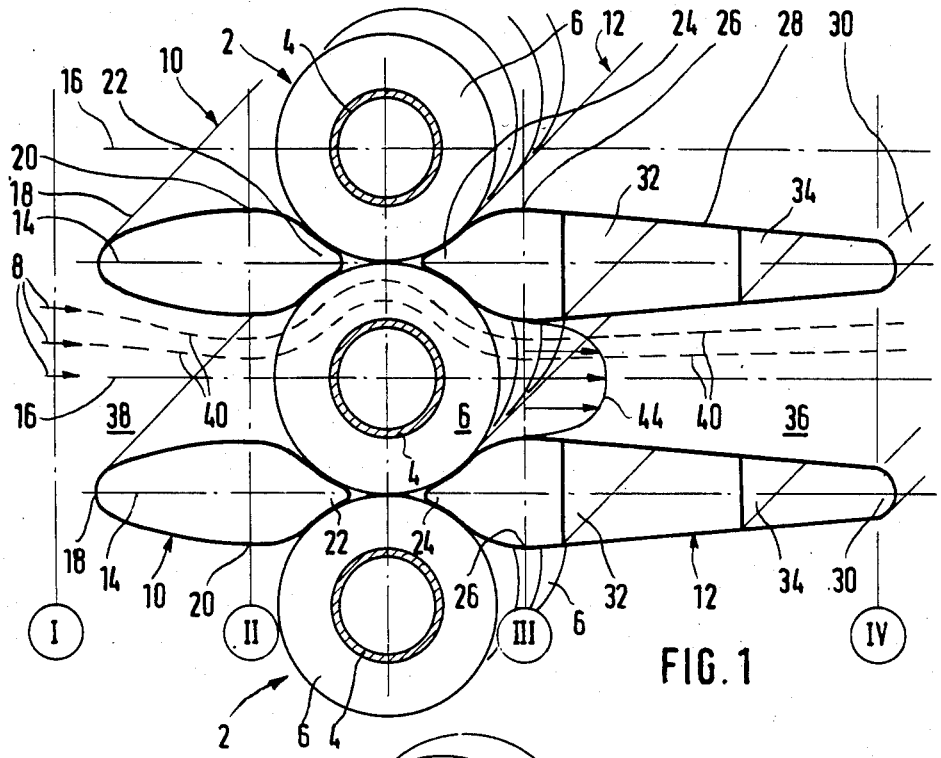
FIG. 1 is a cross section through a perspective presentation of a finned tube arrangement according to the invention.

The finned tube arrangement shown in FIG. 1 comprises finned tubes 2 including inner tubes 4 in which a first medium flows, such as water to be cooled. Fins 6 of annular disc shape are arranged at uniform spacings along the axis of the inner tubes 4. In the embodiments shown, the fins 6 lie in radial planes with respect to the inner tube 4. Instead of the fins 6 one continuous fin may be wound like a spiral around the inner tubes 4.

A second medium, such as air serving to cool the first medium flowing in the inner tubes 4 passes in cross current transversely of the single layer finned tube arrangement according to FIG. 1, as indicated by the direction of the arrows 8. Flow guide elements 10, 12 are disposed in planes 14 upstream and downstream in the inflow direction of the single layer finned tube arrangement shown in FIG. 1. The planes 14 are offset parallel to the main inflow planes 16 so that they just divide in half the distance between two adjacent main inflow planes and come to lie in the gap between two adjacent finned tubes 2. The flow guide elements 10 disposed in the inflow of the air are thickened in the direction of flow from their rounded leading end 18 to a place 20 of maximum thickness behind their middle. Subsequently they terminate in a trailing end 22 which is concavely curved at both sides in adaptation to the peripheries of the fins 6 of adjacent finned tubes. Because of this design the trailing end 22 fits snugly into the gap between adjacent finned tubes 2 where it can be anchored easily by known bonding methods, such as cementing, welding, screwing or the like. If the flow guide elements 10 are made of extruded synthetic plastic sectional elements, a circumstance which may be favorable for manufacturing reasons, and if the finned tubes 2 are made of metal, a bond or snap connection is convenient with which elastic parts of the flow guide elements are pushed resiliently on the finned tubes and held by clamping. The flow guide elements 12 disposed in the outflow have a leading end 24 which is designed symmetrically with respect to the trailing end 22 of the flow guide elements 10. The leading end 24 thus fits snugly from the other side of the finned tube arrangement into the gap formed between adjacent finned tubes 2. The place of maximum thickness 26 of these flow guide elements 12 is at the same distance from the leading end as the place of maximum thickness 20 of the flow guide elements 10 at the trailing end. From this place 26 of maximum thickness the flow guide elements 12 taper almost rectilinearly throughout a rather long stretch 28 up to the trailing rounded end 30. The long stretch 28 is reinforced by two cross walls 32, 34 placed inside the flow guide elements 12.

Therefore, as seen in the direction of flow 8, adjacent flow guide elements 12 open outwardly so as to form a diffusion channel 36 between two flow guide elements. Contrary to that, adjacent flow guide elements 10 at the outflow side form nozzle channels 38 which are constricted toward the places 20 of maximum thickness. With the central finned tube 2 of the arrangement according to FIG. 1 flow paths 40 are shown in the upper half to represent the course of the flow of air as guided by the flow guide elements 10, 12. Reference numerals I, II, III, IV indicate four reference planes which extend transversely of the main flow direction. In reference plane I the air flow still is practically undisturbed. In reference plane II the flow experiences its greatest constriction prior to entering between the individual fins 6 of the finned tubes 2. In other words, reference plane II contains the places 20 of maximum thickness of the flow guide elements. Thereafter the flow divides to pass around the inner tubes 4, the flow guide elements 10 taking care that the flow between the fins 6 is guided close to the inner tubes 4.

In plane III which contains the places 26 of maximum thickness of the flow guide elements 12 the flows are again united. Here the velocity profile 44 of the flow is shown in plane III between two flow guide elements 12. The profile discloses no pronounced excessive velocities, i.e. the difference between the velocity maximum and minimum is rather small. Plane III is followed by the diffusion channel 36 in which the flow is delayed until plane IV is reached so that a considerable proportion of kinetic energy is recovered in the form of pressure energy.

Figure 2:
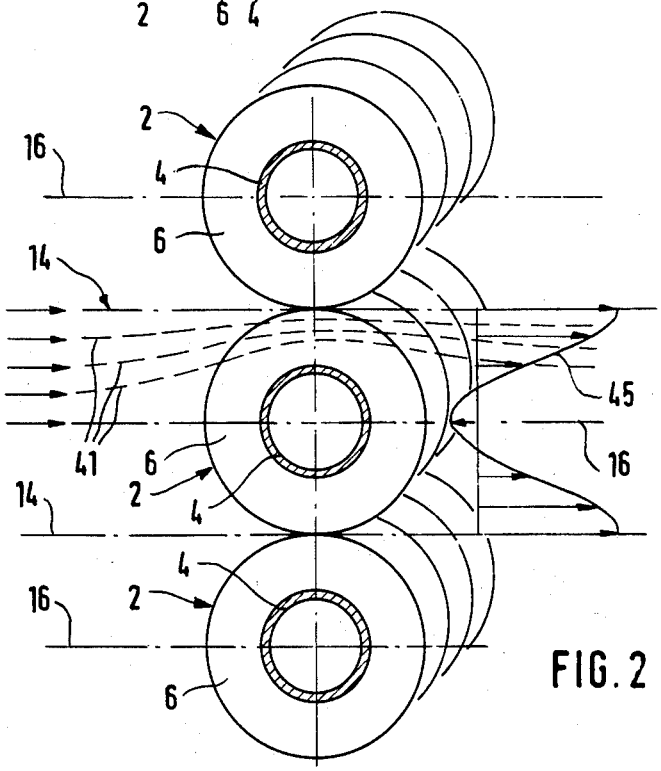
FIG. 2 is a cross section like FIG. 1 through a finned tube arrangement without any flow guide elements for purposes of comparison.

For comparison, FIG. 2 shows a conventional finned tube arrangement similar to that of FIG. 1, but without any flow guide elements. The flow paths designated 41 in this case are more narrowed than in FIG. 1 at the inflow side and in the direction toward the gap plane 14 between two adjacent finned tubes 2. In other words, the air flow is not guided close to the inner tubes 4 of the finned tubes 2, as is the case in FIG. 1. The resulting velocity profile 45 is shown in the drawing in a reference plane in the outlet. This velocity profile has its maxium in the planes 14 each and has a negative minimum in the main inflow planes 16 of the finned tubes 2. This means that a dead water area in which air flows back is formed in the range of the inner tubes at the outflow side. This causes loss. It should also be noted that the maximum of the flow velocity at the outflow side is much higher than in the case of the velocity profile 44 according to FIG. 1. With such a velocity profile even the downstream provision of diffusion members permits recovery of rather a small proportion only of pressure energy.

Since the air flow is directed toward the inner tubes 4 in the case of FIG. 1, the coefficient of heat transfer is increased as compared to FIG. 2 where the major portion of the gas flow is passed at a greater distance from the inner tubes, i.e. along the colder outer areas of the fins.

In the simplest case the flow guide elements 10 or 12 may be embodied by round cylindrical tubes. Of course, the embodiment shown of slender sectional elements is more favorable under aspects of the flow technique, i.e. the pressure losses of the flow can be kept smaller.

In actual embodiments the angle of opening of the diffusion channel 36 advantageously should be in a range of from 4° to 10°.

Figure 3:
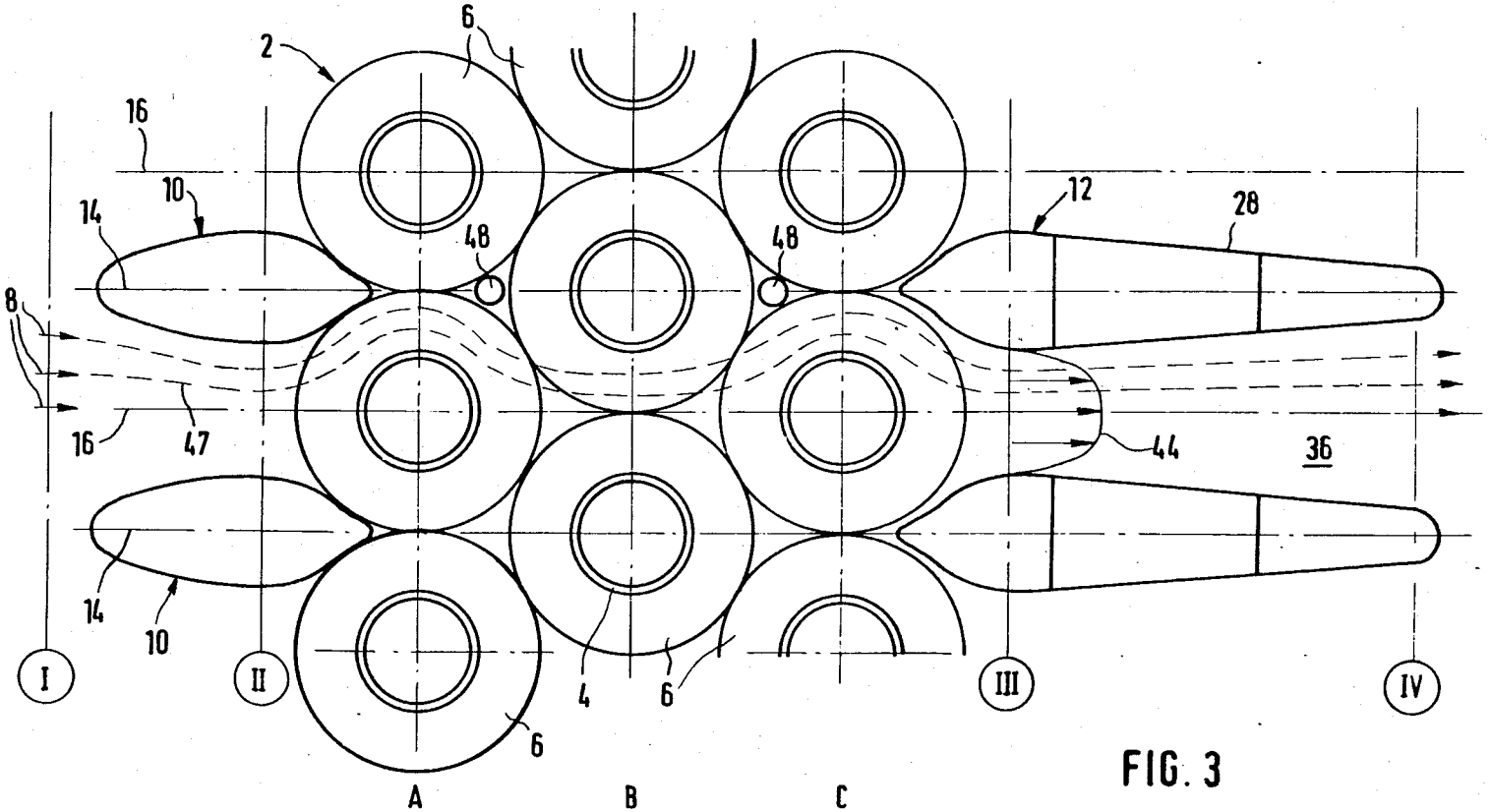
FIG. 3 is a section through a finned tube arrangement in a pack including closely spaced finned tube layers and flow guide elements according to the invention.

FIG. 3 shows a finned tube arrangement including a pack of three finned tube layers A, B, C arranged offset with respect to one another. The finned tubes 2 of this arrangement are designed as shown in FIG. 1 so that they are not described again. The layers of finned tubes are disposed offset with respect to each other in a tight pack, i.e. with the fins 6 of the individual finned tubes having circumferential contact. Also the flow guide elements 10, 12 are designed as shown in FIG. 1. In accordance with FIG. 1, these flow guide elements are disposed in planes 14 which are offset with respect to the main inflow planes 16 as regards the finned tube layers A and C. In this case the main inflow planes or the planes containing the axes of the finned tubes 2 of intermediate layer B coincide with the planes 14.

As the flow guide elements 10, 12 are designed exactly as shown and described with reference to FIG. 1, they are not described again. In the upper part of FIG. 3, a circular tube shaped flow guide element 48 each is disposed in front of and behind the intermediate layer. This flow guide element is to contribute to a useful flow around the inner tubes 4 of the finned tubes 2 in the intermediate layers B and C. As an alternative these additional flow guide elements 48 may be dispensed with, as shown in the lower half of FIG. 3. The flow paths designated 47 in this case extend as shown in FIG. 1 in the inflow area between reference planes I and II and in the outflow area between reference planes III and IV. In principle also the same velocity profile 44 of the flow as shown in FIG. 1 is formed in reference plane III. When applying the flow guide elements 10, 12 in a tight pack finned tube arrangement as shown in FIG. 3, therefore, practically the same effects are obtained as described with reference to FIG. 1, at least as regards the first and last layer.

Figure 4:
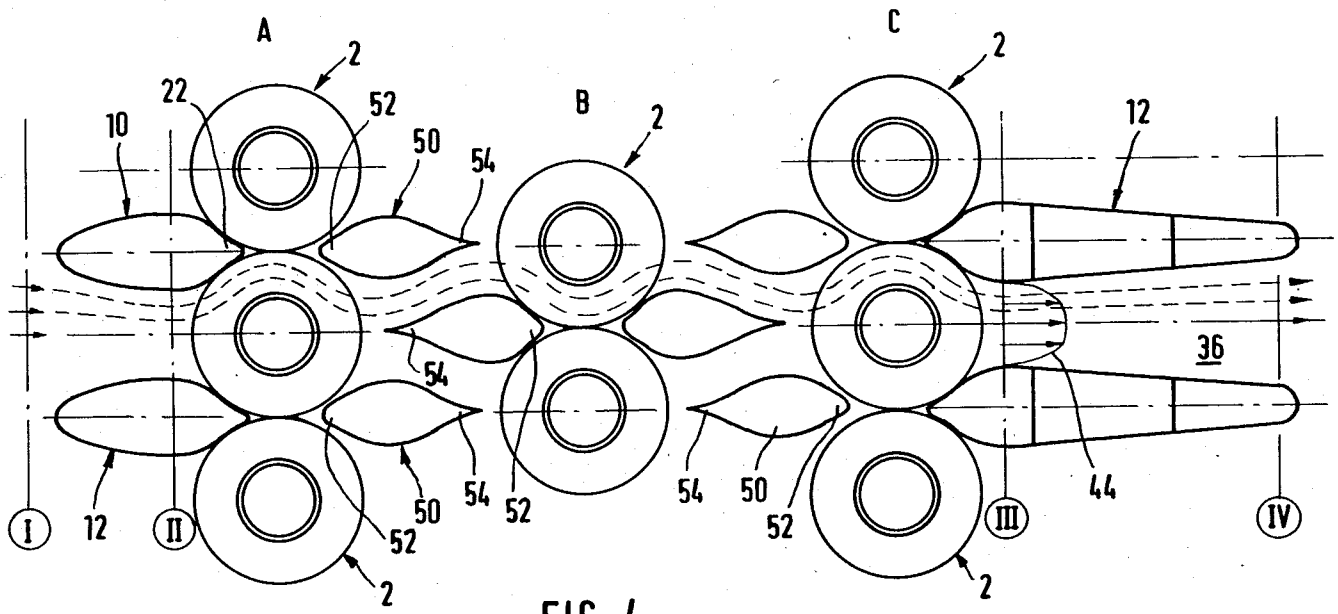
FIG. 4 is a sectional presentation of a finned tube arrangement in a pack including widely spaced finned tube layers and flow guide elements according to the invention.

FIG. 4 shows a finned tube arrangement which has finned tube layers A, B, C disposed spaced apart and also comprises flow guide elements 10 and 12 in accordance with FIG. 1 in the inflow and outflow ranges. In this respect it is unnecessary to repeat the description. However, in this case streamlined flow guide elements 50 are disposed also between individual finned tube layers. These flow guide elements 50 which likewise extend throughout the length of the tubes are designed at one end 52 similar to the trailing end 22 of the flow guide elements 10. Thus they also fit snugly into the gap formed between two adjacent finned tubes 2 where they may be fixed. At their other end 54 the flow guide elements 50 terminate in a drop-shaped cross section. For simplicity the same flow guide elements 50 are used which, however, are rotated through 180° when provided at the inflow side as compared to the flow guide elements 50 disposed at the outflow side. Thus the end 54 faces the inflow direction and end 52 which is designed to fit into the gap formed between two finned tubes 2 is orientated in outflow direction. The flow guide elements 50 provide a favorable flow guidance of the gas stream between layers A and C.

Figure 5:
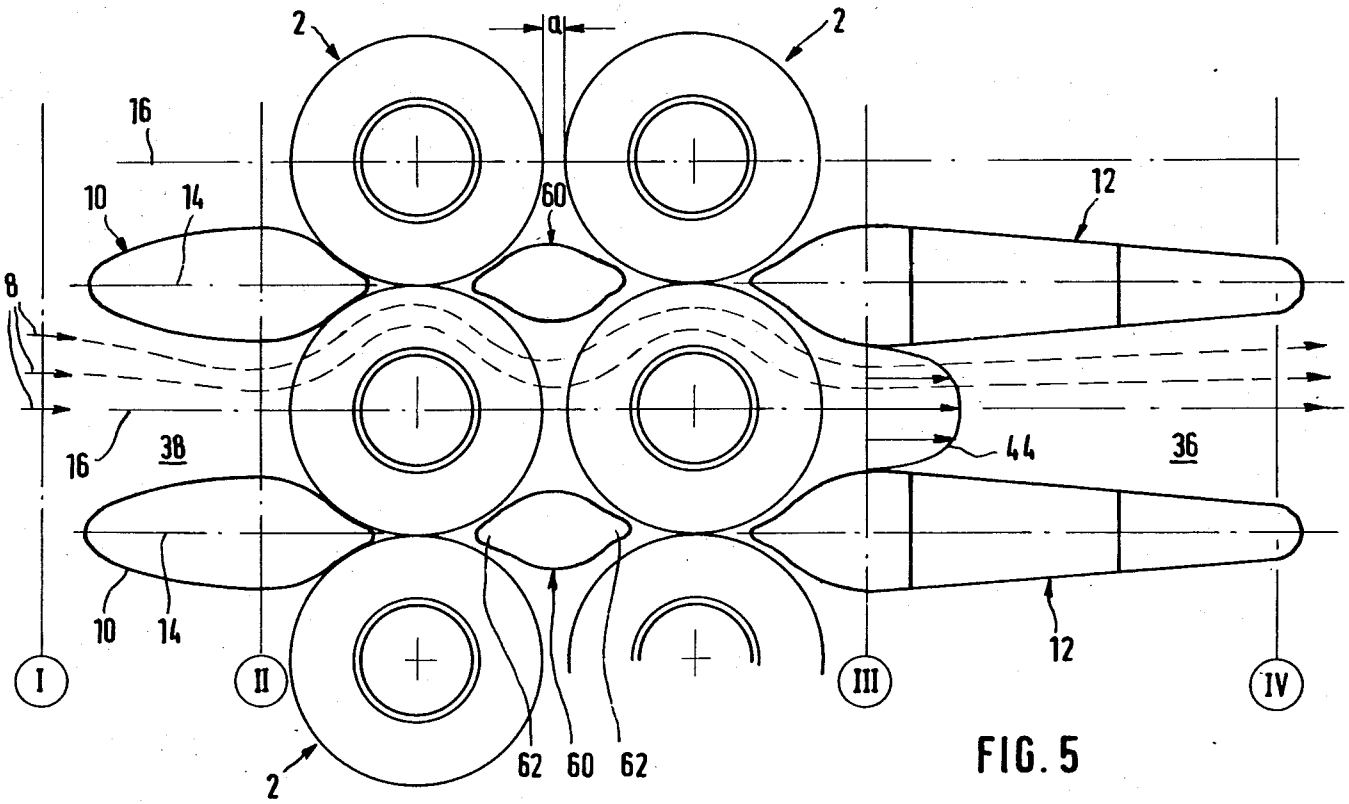
FIG. 5 shows a finned tube arrangement in a pack, including two layers of finned tubes disposed in the same planes and flow guide bodies according to the invention.

FIG. 5 shows a finned tube arrangement comprising only two finned tube layers in which the finned tubes 2 of the individual layers are disposed in the same inflow planes 16 and their fin peripheries are spaced apart by a distance a. In the area of plane 14 in which flow guide elements 10 and 12 are disposed at the inflow and outflow sides, respectively, as in FIGS. 1, 3, and 4, additional flow guide elements 60 are provided which are designed symmetrically as seen in the direction of flow, i.e. they have ends 62 which fit snugly into the corresponding gaps between two finned tubes 2 each at the inflow and outflow sides. The resulting cross sectional shape of these flow guide elements 60 is similar to a lemon. The flow guide elements 60 provide a favorable streaming distribution of the flow between the two finned tube layers and good flow toward the inner tubes 4 at the downstream finned tube layer. It should also be mentioned that the flow guide elements 60 may be connected to the fins 6 in the same manner as flow guide elements 10, 12.

Figure 6:
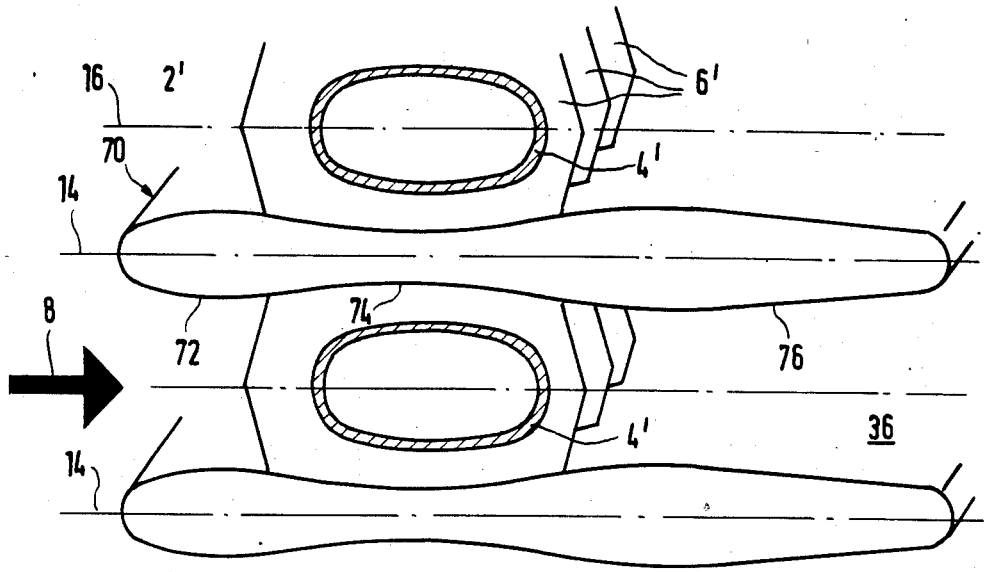
FIG. 6 shows a finned tube arrangement according to the invention including oval tubes and continuous flow guide elements according to the invention.

FIG. 6 shows a single layer arrangement of finned tubes 2' having oval inner tubes 4' and angular fin plates 6' which may be made in one piece for the entire layer. Unitary flow guide elements 70 are provided in the planes 14 at the same spacing from the main inflow planes 16 of the inner tubes 4' and parallel to the same. These flow guide elements have an inlet portion 72, a tapering portion 74 of an outline adapted to the oval inner tubes 4', and an outlet portion 76 which tapers at both sides like the flow guide elements 12 so as to define diffusion channels 36. It is obvious that also in this case the gas (air) flowing in the direction of arrow 8 is guided in favorable flow close to the oval inner tubes 4' and is passed away from the finned tube arrangement at the outflow side, while permitting pressure recovery.

Figure 7:
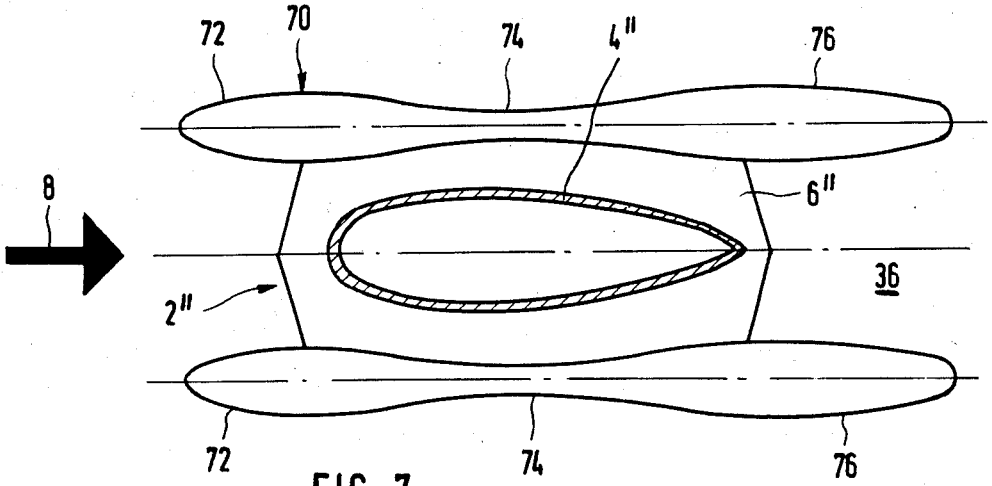
FIG. 7 shows a finned tube arrangement including finned tubes of favorable flow design and flow guide elements according to the invention.

The embodiment shown in FIG. 7 differs from the one according to FIG. 6 only in that the inner tubes 4'' have a favorable flow outline so as to reduce the losses still further as compared to the embodiment shown in FIG. 6.

The tapering intermediate portion 74, of course, in this case is adapted to the outline of the inner tubes 4''.

Figure 8:
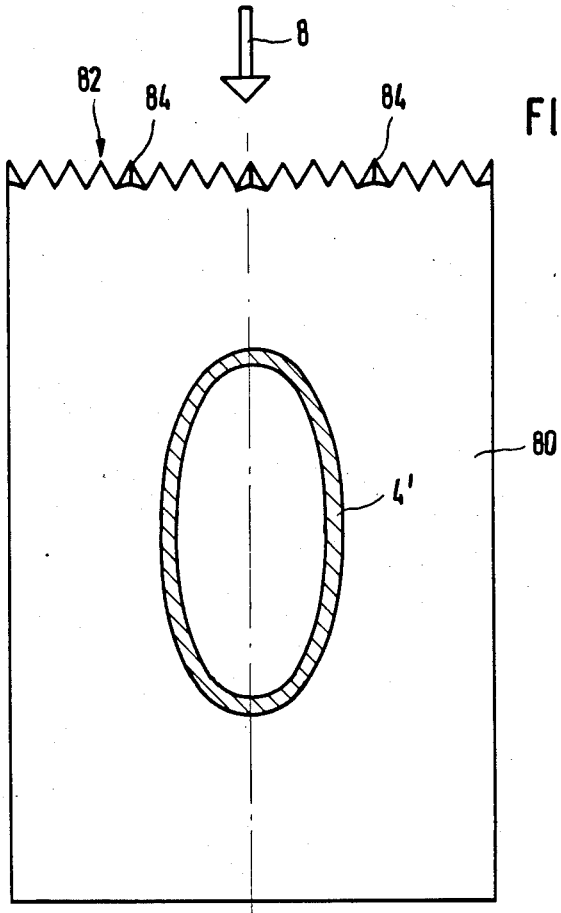
FIG. 8 is a sectional presentation of a finned tube arrangement according to the invention with which flow guide elements each are provided at the front edge of the fins.
Figure 9:
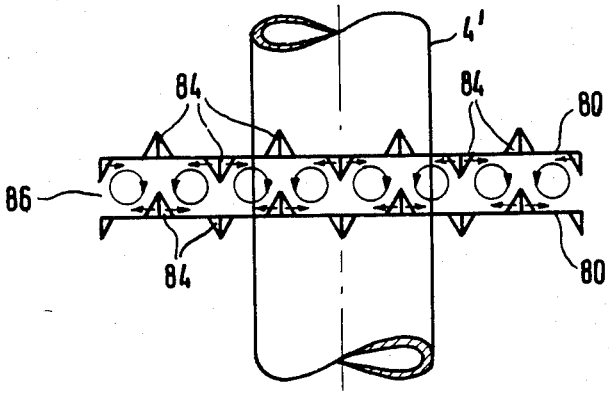
FIG. 9 is a part side elevational view of the finned tube arrangement shown in FIG. 8.

FIGS. 8 and 9 show a modified embodiment. The oval inner tubes 4' of a tube arrangement are furnished with rectangular fins 80 which extend transversely of the longitudinal axis of the inner tube, as was the case with the other embodiments described. Triangular lugs are cut out of the front edge 82 and bent at an angle so as to form flow guide elements 84. These flow guide elements 84 facing the inflow direction 8 generate a regular turbulent flow in the area behind the front edge 82 including longitudinal vortices in the center of which warmer air collects in accordance with the law of cyclones, while the colder air circulates in the outer ranges of the turbulences produced. When passing between the fins 80 the circumferential speed of the longitudinal vortices increases, while the air is accelerated because of the displacing effect of the inner tubes 4'. In this manner again cool air is brought into contact with the inner tubes 4' and the fins to provide improved cooling. Hereby the coefficient of heat transfer is increased.

FIG. 9 is a front elevational view of the arrangement according to FIG. 1 showing two fins 80 side by side. It may be seen that with each fin 80 the flow guide elements 84 are bent alternatively toward opposed sides of each edge 82, as described, so that the flow guide elements 84 protruding from the one fin 80 into the channel 86 defined between two fins 80 are offset with respect to the flow guide elements 84 which protrude into the same gap 86 from the other fin 80. The longitudinal vortices released from both sides of the flow guide elements rotate in opposite direction, as indicated in the presentation of FIG. 9. Application of the flow guide elements 84 described with reference to FIGS. 8 and 9 provides a marked increase of the coefficient of heat transfer as compared to the former solutions (cf. FIG. 2).

The flow guide elements 84 as shown in FIGS. 8 and 9 may be provided in addition in the embodiments according to FIGS. 1 to 7 so as to obtain an advantageous combination of the effects described.

Figure 10:
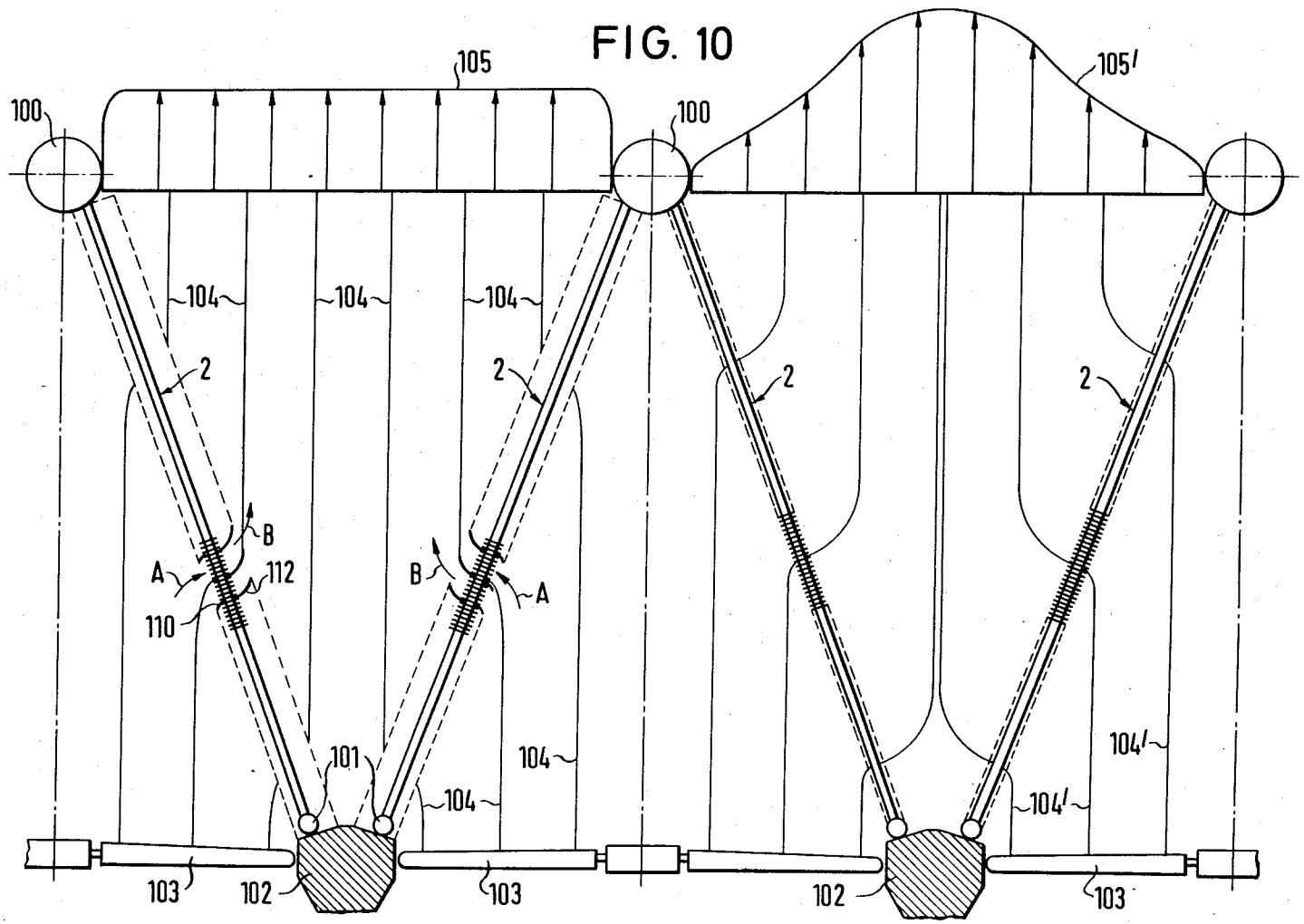
FIG. 10 is a cutaway portion of a finned tube assembly in a ventilator dry cooling tower, the right half illustrating a conventional finned tube assembly, while the left half illustrates a finned tube assembly according to the invention.

In the embodiment of FIG. 10, layers of finned tubes 2 are arranged in pairs each of V-shaped inclination with respect to each other in the housing of a ventilator dry cooling tower. At their upper ends the finned tubes open into supply channels 100 for steam to be condensed, while the lower ends of the tubes 2 open into collecting channels 101 for the condensate flowing from top to bottom. The collecting channels 101 are supported on carrier beams 102. Ventilators 103 generating air flow in the direction of flow lines 104, 104' from the bottom to the top are shown between the carrier beams 102.

A conventional arrangement is shown in the right half of the drawing. The air flow must pass the fins 6 which are disposed radially around the inner tubes 4. No special measures for this purpose are taken with the finned tube assembly illustrated in the right half of FIG. 10 and therefore the flow lines take the course marked 104'. This course, on the one hand, involves flow losses, a fact demonstrated not only by the course taken by the flow lines 104' but also by the course of the velocity profiles 105' in the outlet, including a maximum in the middle and drops towards the supply channels 100.

With the arrangement presented in the left half of FIG. 10, on the other hand, flow guide members 110, 112 are provided in accordance with the invention, both in the inflow and outflow, and these produce the course 104 of flow lines. The resulting deflection in this case is practically free of loss so that the air generated by the fans or ventilators 103 flows in transverse direction to the finned tubes. The air also leaves the finned tubes in this direction. This yields the course of velocity 105 which is uniform across the full width of the outlet.

Figure 11:
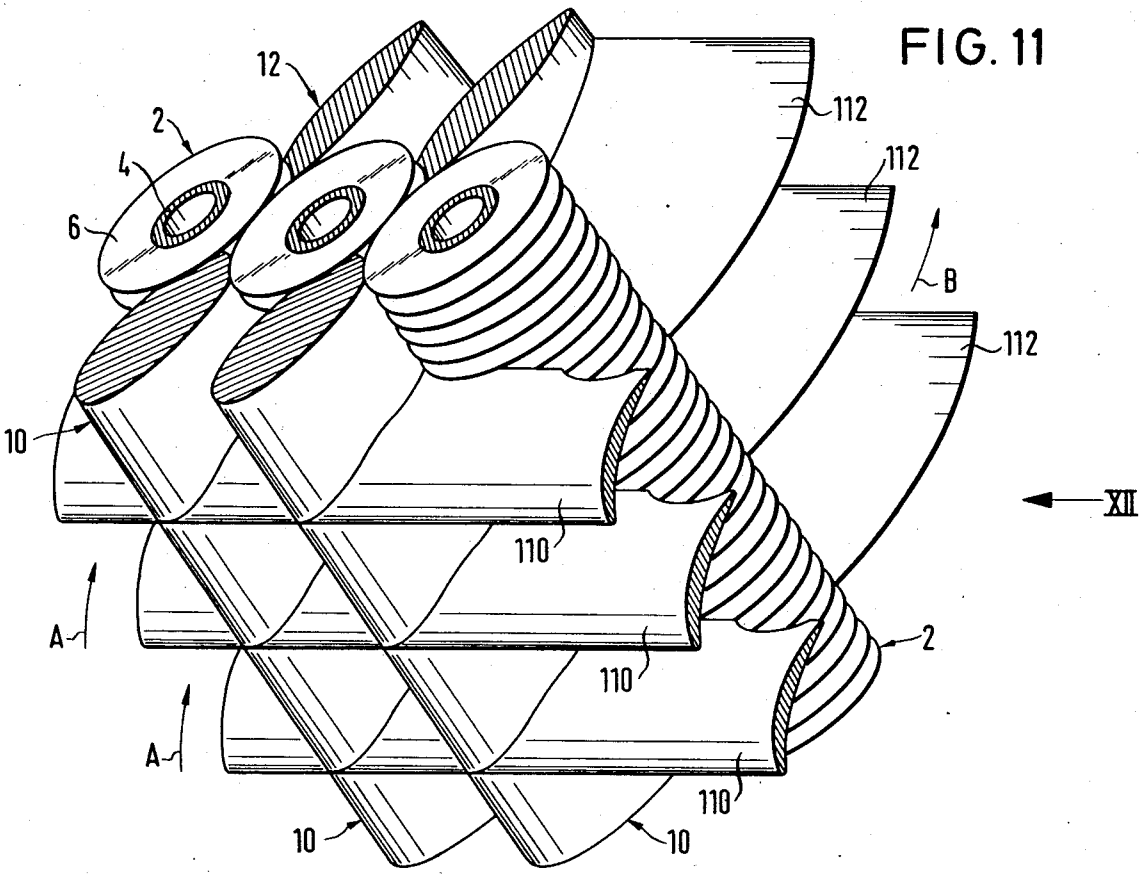
FIG. 11 is a perspective view, partly in section, of a finned tube assembly according to the invention.
Figure 12:
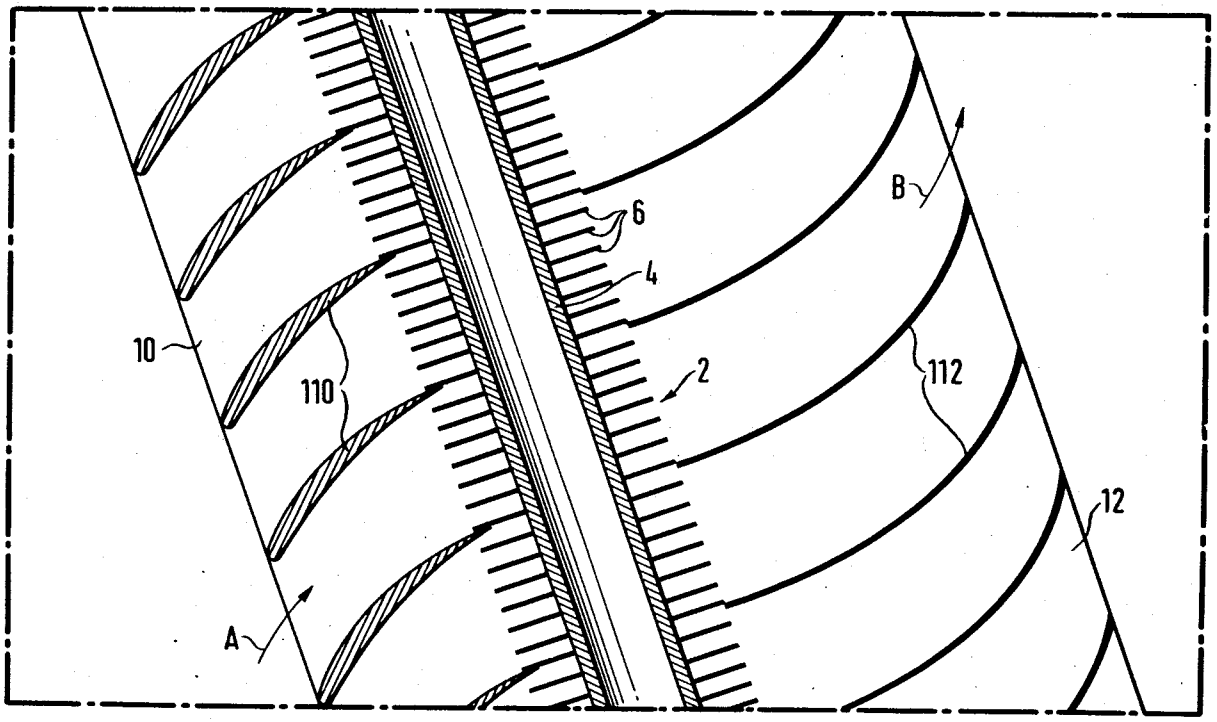
FIG. 12 is a partial sectional elevation as seen in the direction of the arrow III in FIG. 11.

An assembly in accordance with the invention is shown in detail in FIGS. 11 and 12.

As will be seen, flow guide members 110, 112 in the form of extruded sectional elements are arranged in longitudinal direction of the finned tubes 2 including the inner tubes 4 and the fins 6. They will not be described again.

Alignment of the inflow in the direction of arrow A in a direction transversely of the longitudinal extension of the finned tubes 2 is obtained by the provision of flow guide members 110 which are arranged at the inflow side and at a spacing which may correspond to from one to five times the diameter of the inner tube 4, preferably being twice the diameter of the inner tube. The flow guide members 110 at the inflow side are curved in the manner of airfoils toward the direction of inflow A and they have a thickened portion in the middle, as with airfoils. The flow guide member 112 at the outflow side likewise are curved like airfoils in the outflow direction b, in other words in opposite direction to the flow guide members 110 at the inflow side. Their cross section of small thickness (sheet metal sectional members) is uniform throughout their length. However, also in this case, of course, thickening toward the center could be provided.

This modification may be taken from FIG. 12 as well which also shows that the tangents of the ends of the flow guide members 112 at the outflow side approximately are the vertical lines.

Flow guide members 110, 112 afford improvement even without the provision of flow guide members 10, 12.

All flow guide members 10, 12, 110, 112 may be of sound dampening design, for instance by being hollow. In the case of sheet metal sectional members, a sound-absorbing plastic mass may be applied on the sheet metal core, such as by spraying.

The flow guide members also may be solid members of sound dampening foamed plastic material. In this manner additional sound-proofing measures may be dispensed with which otherwise frequently are required to meet emission regulations and which may result in considerable pressure losses.

While in accordance with the provisions of the Patent Statute the preferred forms and embodiments of the invention have been illustrated and described, it will be apparent to those skilled in the art that various changes and modifications may be made without deviating from the inventive concepts set forth above.

What is claimed is:

1. In a finned tube heat exchanger assembly including a plurality of parallel tubes each having a plurality of longitudinally-spaced, radially-extending annular fins mounted concentrically thereon, thereby to afford heat transfer between a first fluid medium flowing through the tubes and a second medium flowing externally thereof, the improvement which comprises (a) a plurality of first flow guide members arranged parallel to said finned tubes and in the inflow and outflow paths of said second fluid medium with respect to said finned tubes; and (b) a plurality of second flow guide members arranged transversely of said finned tubes and said first flow guide members in the inflow and outflow paths of said second medium with respect to said finned tubes, said first and second flow guide members arranged in the inflow path defining generally a lattice for directing said second medium across said tubes in a direction normal to the axes thereof;

(c) said first flow guide members each having a symmetrical streamlined configuration relative to a center plane extending in the lengthwise direction thereof and each of said second flow guide members having an airfoil configuration including a first portion of maximum thickness and a second blade portion of minimum thickness arranged on opposite sides of said tubes, said first and second portions being curved to provide each of said second flow guide members with a generally S-shaped configuration, whereby when said second medium is directed toward said second flow guide member first portions, said second medium is directed by said first portions across said tubes in a direction normal to the axis thereof and by said portions to an outlet.

2. A finned tube assembly as defined in claim 1, wherein the distance in the direction of tube length between adjacent ones of said second flow guide members is in the range of from 1 to 5 times the diameter of said tubes.

3. A finned tube arrangement as defined in claim 1, wherein said flow guide members are constructed of hollow members covered with a layer of sound-dampening synthetic plastic material to dampen noise.

4. A finned tube arrangement as defined in claim 1, wherein said flow guide members are made of noise dampening material comprising foamed synthetic plastic material.

* * * * *